US010907823B2

(12) United States Patent
Kramer

(10) Patent No.: US 10,907,823 B2
(45) Date of Patent: Feb. 2, 2021

(54) EVAPORATOR SYSTEM

(71) Applicant: Siemens Aktiengesellschaft, Munich (DE)

(72) Inventor: Walter Adriaan Kramer, Rotterdam (NL)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 116 days.

(21) Appl. No.: 16/343,184

(22) PCT Filed: Oct. 24, 2017

(86) PCT No.: PCT/EP2017/077144
§ 371 (c)(1),
(2) Date: Apr. 18, 2019

(87) PCT Pub. No.: WO2018/082967
PCT Pub. Date: May 11, 2018

(65) Prior Publication Data

US 2019/0249865 A1 Aug. 15, 2019

(30) Foreign Application Priority Data

Nov. 2, 2016 (EP) ..... 16196841

(51) Int. Cl.
*F22B 37/26* (2006.01)
*F22D 1/00* (2006.01)
(Continued)

(52) U.S. Cl.
CPC ..... *F22B 37/261* (2013.01); *F22B 1/18* (2013.01); *F22B 21/005* (2013.01); *F22B 37/26* (2013.01); *F22B 37/266* (2013.01); *F22D 11/00* (2013.01)

(58) Field of Classification Search
CPC ..... F22B 37/141; F22B 37/143; F22B 37/26; F22B 37/261; F22B 29/06; F22B 29/08;
(Continued)

(56) References Cited

U.S. PATENT DOCUMENTS 5,762,031 A * 6/1998 Gurevich ..... F22B 1/1815 122/1 C
6,173,679 B1 1/2001 Bruckner et al.
(Continued)

FOREIGN PATENT DOCUMENTS

CN 201521940 U 7/2010
CN 103635746 A 3/2014
(Continued)

OTHER PUBLICATIONS

International search report and written opinion dated Jan. 4, 2018 for corresponding PCT/EP2017/077144.

*Primary Examiner* — Gregory A Wilson

(57) ABSTRACT

An evaporator system for an industrial boiler, containing a heat transfer system, a separator for separating water and steam and a dryer for drying the separated wet steam. A horizontal vessel contains a required minimum amount of water, a relatively small steam volume and internals for the separation of water and wet-steam. A vertical vessel contains internals for drying the wet steam to predetermined values by separating liquid from the wet-steam. The horizontal vessel and the vertical vessel are connected to each other by wet-steam piping through which separated wet-steam is transported from the horizontal vessel to the vertical vessel. The vertical vessel has a connection to dry-steam piping for discharging dried steam. The vertical vessel has a connection to a liquid drain piping for transporting liquid from the vertical vessel back to the inlet conduits of the evaporator heat transfer section.

2 Claims, 1 Drawing Sheet

(51) Int. Cl.

| | |
|---|---|
| ***F22B 1/18*** | (2006.01) |
| ***F22B 21/00*** | (2006.01) |
| ***F22D 11/00*** | (2006.01) |

(58) Field of Classification Search
CPC . F22B 29/10; F22D 1/00; F22D 1/003; F22D 1/02
See application file for complete search history.

(56) References Cited

U.S. PATENT DOCUMENTS

| | | | | |
|---|---|---|---|---|
| 7,243,618 | B2 * | 7/2007 | Gurevich | F22B 1/1815 122/406.1 |
| 8,915,217 | B2 * | 12/2014 | Rop | F22B 29/06 122/7 R |
| 2008/0190382 | A1 * | 8/2008 | Bruckner | F22B 1/1815 122/7 R |
| 2012/0240871 | A1 | 9/2012 | Bairley et al. | |
| 2012/0312019 | A1 * | 12/2012 | Rechtman | F22B 35/007 60/645 |
| 2014/0041839 | A1 | 2/2014 | Jackson | |
| 2019/0049104 | A1 * | 2/2019 | Yu | F22B 29/064 |

FOREIGN PATENT DOCUMENTS

| | | | |
|---|---|---|---|
| CN | 204880071 | U | 12/2015 |
| EP | 1526331 | A1 | 4/2005 |
| JP | S49-031045 | Y | 8/1974 |
| JP | H0849805 | A | 2/1996 |
| JP | H09178102 | A | 7/1997 |
| JP | 2005188759 | A | 7/2005 |
| WO | 9901697 | A1 | 1/1999 |
| WO | 2007133071 | A2 | 11/2007 |
| WO | 2009105309 | A1 | 8/2009 |

* cited by examiner

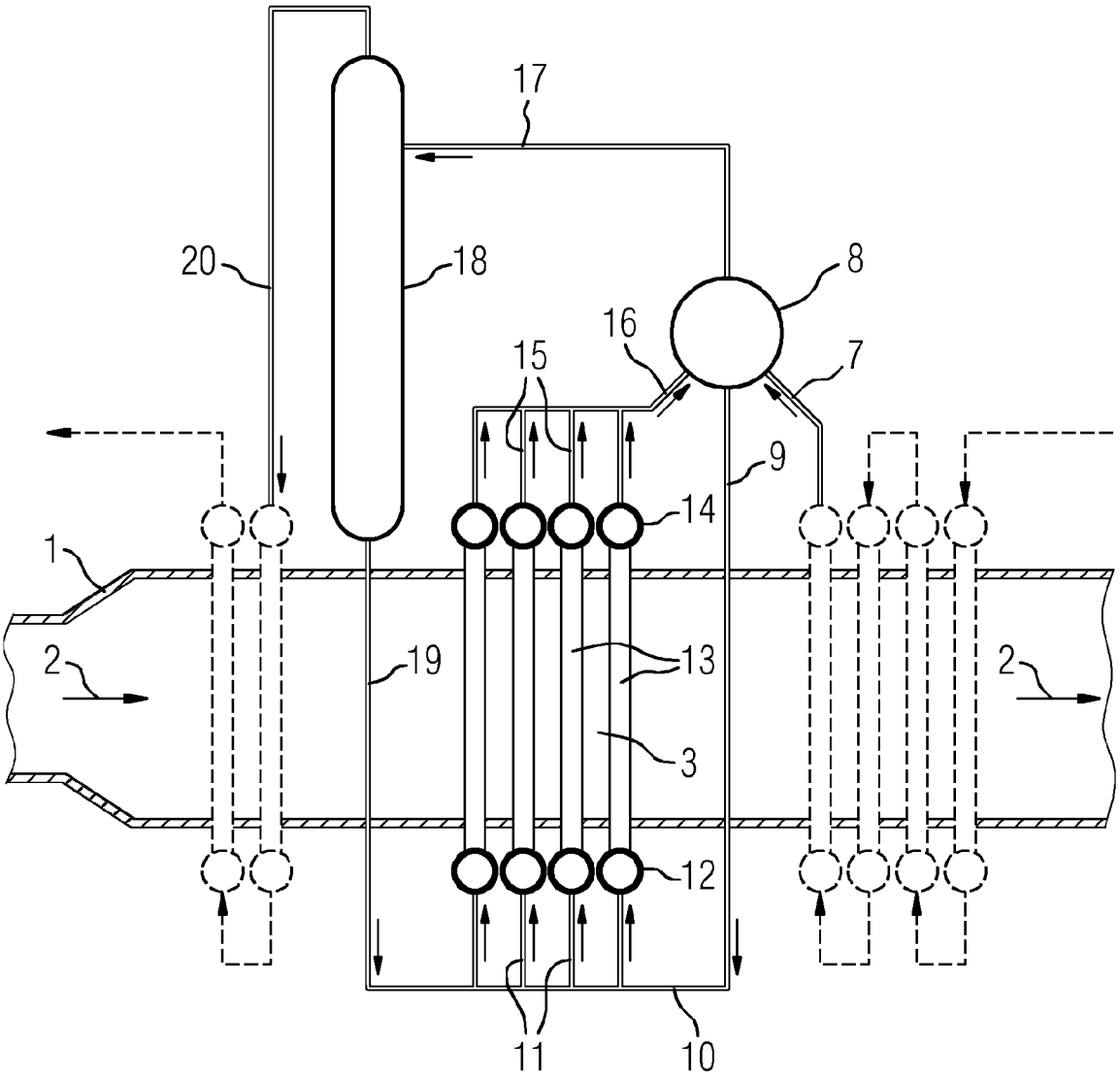
17
20
18
8
16
15
7
9
14
1
2
19
13
2
3
12
11
10

EVAPORATOR SYSTEM

CROSS REFERENCE TO RELATED APPLICATIONS

This application is the US National Stage of International Application No. PCT/EP2017/077144 filed Oct. 24, 2017, and claims the benefit thereof. The International Application claims the benefit of European Application No. EP16196841 filed Nov. 2, 2016. All of the applications are incorporated by reference herein in their entirety.

FIELD OF INVENTION

The invention relates to an evaporator system for an industrial boiler.

BACKGROUND OF INVENTION

In its most fundamental form such an evaporator system consists of at least one water-steam drum, at least one evaporator heat transfer section and respective interconnecting piping. Water from the drum is transported to the evaporator heat transfer section where it is partly evaporated. The so generated water-steam mixture is transported back to the drum, where the steam is separated from the water and the separated steam is dried. Other connections on the evaporator system are for feed water supply and steam extraction. Conventionally, such a water-steam drum is a vessel with relatively large diameter because of the functions it has to fulfill. It is designed to contain the minimum amount of water required among others to guarantee the steam generation of the boiler when the feed water supply to the drum is momentarily interrupted. It is designed to contain the minimum steam volume required among others to have space for a water-steam separator and a steam dryer to realize a guaranteed steam purity at steam extraction and to have space for a water level that shifts to compensate for the fluctuating amount of water contained in the heat transfer section during start-up, shut-down and other load changes of the boiler.

Contrary to the before mentioned drum, further developed evaporator systems as known from e.g. EP 1 526 331 A1 comprise two vessels. A horizontal vessel is designed for separating water and wet-steam and a vertical vessel is designed for drying this wet-steam. The horizontal and the vertical vessels being connected to each other by a wet-steam piping, through which the separated wet-steam is transported from the horizontal to the vertical vessel. Additional pipes connect the horizontal vessel with the heat transfer section. An embodiment as disclosed in EP 1 526 331 A1 comprising an additional piping through which water, separated in the vertical vessel is transported back directly to the horizontal vessel.

SUMMARY OF INVENTION

Now, it is an object of the present invention to provide a further detailed evaporator system.

According to the present invention, this object is achieved with an evaporator system according to the claims.

As a consequence of transporting liquid from a vertical vessel back to an at least one input conduit of an evaporator heat transfer section, use is made of the driving force exerted by the circulating evaporative heat transfer section. Therefore the liquid level in the vertical vessel needs not be above the water level in a horizontal vessel to create the necessary pressure to force the separated liquid to flow back to the evaporator system. In fact the liquid level in the vertical vessel could be below the water level in the horizontal vessel and could even drop inside the liquid drain piping between the vertical vessel and the inlet conduits of the heat transfer section. This will further reduce the risk of liquid carrying over from the vertical vessel to e.g. a downstream superheater system.

In an embodiment, the liquid drain piping comprising one common liquid drain pipe, where separated liquid from multiple vertical separator vessels is collected wherein the one common drain pipe is of large enough diameter to ensure negligible friction pressure loss when liquid is transported from the separator vessels to the inlet conduits of the heat transfer section.

BRIEF DESCRIPTION OF THE DRAWINGS

The invention now will be explained in more detail with reference to the appended drawing.

The drawing shows only an example of a practical embodiment of the invention, without limiting the scope of the invention.

DETAILED DESCRIPTION OF INVENTION

Quite similar to what is known from EP 1 526 331 A1, also the present evaporator system is embedded and positioned at least partially within a substantially horizontal gas conduit 1 which is guiding a heating gas flow 2. The evaporator system is designed for transferring heat from the gas flow 2 to a flow medium, which flows through the evaporator system. The evaporator system has at least one evaporator heat transfer section 3, which comprises a plurality of substantially vertically extending heat transfer tubes 13. Typically such heat transfer tubes 13 are arranged in a matrix having arrays of heat transfer tubes 13 in a direction transversal to the flow direction of the heating gas 2. The heat transfer section 3 is in fluid communication with at least one inlet conduits 10 for supplying typically water as flow medium to the heat transfer tubes 13, where it is partially evaporated and with at least one outlet conduit 16 for transferring the flow medium as two-phase mixture of water and wet-steam to at least one horizontal vessel 8 for a primary water and wet-steam separation. Such a horizontal separation vessel 8 is also connected to the inlet conduit 10 for transporting water from the at least one horizontal vessel 8 back to the inlet conduits 10. The horizontal separation vessel 8 is also in fluid communication with at least one outlet conduit 9 to transfer the separated water from the horizontal vessel 8 back to the inlet conduit 10 of the evaporator heat transfer section. Furthermore, the horizontal vessel 8 is in fluid communication with at least one wet-steam piping 17 to transfer separated saturated vapor phase flow medium (typically the wet-steam) to at least one vertical vessel 18 for a secondary vapor-liquid separation (drying). The horizontal vessel 8 for primary vapor liquid separation is arranged at an upper region of the evaporator heat transfer section. The vertical separation vessel 18 receives the separated wet-steam from the horizontal vessel 8. The vertical separation vessel 18 is also in fluid communication with at least one outlet conduit 20 to extract the dried steam to a downstream superheater system. The inlet conduit 17 of the wet-steam piping 17 into the vertical vessel 18 is arranged above the liquid level of vertical vessel 18. Furthermore, the connection of the separated vapor outlet conduit 20 of the vertical separator vessel 18 is arranged above the liquid level of the horizontal separator vessel 8.

From EP 1 526 331 A1, an evaporator system for an industrial boiler is known, that further includes a piping between the bottom part of the vertical and the horizontal vessel through which water, separated in the vertical vessel 18, is transported back to the horizontal vessel 8. Drawback of this known embodiment is that the flow induced friction pressure loss over interconnecting vapor conduits and vertical separation vessel internals can cause an increased water level in the vertical vessel. The increased water level in the vertical vessel can result in some water carried over with the dried steam, thus reducing the drying capacity of the vertical vessel.

The present invention is focusing on an alternative piping to that piping as described in the drawing of EP 1 526 331 A1. Now the separated liquid from the vertical vessel 18 is routed back through a liquid drain piping 19 to the inlet conduit 10 of the evaporator heat transfer section 3. Since now, both the liquid drain piping 19 as well as the downcomer conduit 9 from horizontal separator vessel 8 are connected to the inlet conduit 10 of the evaporator heat transfer section 3, the medium in both the liquid drain piping 19 and the downcomer conduit 9 are in flow communication. If no heat is transferred from the gas 2 to the flow medium in the heat transfer tubes 13, the density of the flow medium in the heat transfer tubes 13 will be the same as the density of the flow medium in liquid drain piping 19 and downcomer conduits 9 and also the water level in the horizontal vessel 8 is the same as the liquid level in the vertical vessel 18. If heat is transferred from the gas 2 to the flow medium in the tubes 13, the flow medium in the heat transfer tubes 13 will be partly evaporated and the average density of the flow medium in the heat transfer tubes 13 will be lower than the density of the flow medium in the downcomer conduit 9 and in the liquid drain piping 19. Under the influence of gravitation flow medium starts to flow downwards through the downcomer conduit 10 and the wet-steam and water mixture generated in the heat transfer tubes 13 starts to flow upwards. This mixture flows into the horizontal vessel 8, where the wet-steam is first separated from the water and then flows towards the vertical vessel 18. The remaining water supplied to make-up for the loss of flow medium and flows into the downcomer conduit 9. The make-up flow ensures that the water level in the horizontal vessel 8 does not drop. The substantial flow of water flow medium through the downcomer conduit 9 induces friction pressure drop, which counteracts the gravitational head of the water column. Consequently, the net hydrostatic head exerted by the water flowing through the downcomer conduit 9 is reduced. The liquid flow medium in the liquid drain piping 19 from the vertical vessel 18 will also have the tendency to flow downwards to the inlet conduit 10 of the heat transfer section 3. However, the only liquid flow medium available, is due to secondary separation of liquid from vapor entering the vertical vessel 18. No substantial downward flow will set in the liquid drain piping 19 and thus no significant friction pressure loss will counteract the gravitational head. The liquid level in the vertical vessel 18 will have to drop to balance the net hydrostatic head exerted by the liquid flowing through the downcomer conduit 9. The friction head loss in the downcomer conduit 9 minus the friction head loss over interconnecting liquid drain piping 19 and vertical vessel 18 internals equals the elevation head between liquid levels of vertical and horizontal vessels. The drop of liquid level in the vertical separator vessel 18 prevents that liquid is carried over with the dried steam over dry-steam piping 20. When the friction head loss in the downcomer conduit 9 exceeds the friction head loss over interconnecting vapor conduit and vertical separator internals, the liquid level in the vertical vessel 18 will drop below the liquid level in the horizontal vessel 8. Depending on the configuration of actual vertical vessel 18 and the spatial arrangement of this vessel relative to the horizontal vessel 8, the actual liquid level can drop into the liquid drain piping 19. This condition concurs with the objective of the present invention. In the present invention, the heat transfer section 3 is bottom fed, which means that the inlet conduit 10 is arranged at a lower region of the heat transfer section 3. The outlet conduit 16 is arranged at an upper region of the heat transfer section.

The FIGURE is a schematic drawing of a specific embodiment of the present invention. Here the evaporator system comprises at least one evaporator heat transfer sections 3 positioned at least partly in the substantially horizontal gas conduit 1. The heating gas indicated by arrows 2 flows through the gas conduit 1 in a length direction. The liquid flow medium is supplied by one or more supply conduits 7 to the primary horizontal vessels 8. Via the downcomer conduits 9 water flows to inlet conduits 10 and through distributing manifolds 11 and distributing headers 12 as flow medium to the evaporator heat transfer sections 3. The flow medium enters the evaporator heat transfer sections 3 as single phase liquid. The flow medium is heated by the heating gas 2 and is discharged as a two phase mixture of wet-steam and water. At the upper region of the evaporator heat transfer section 3, this mixture is collected via collecting headers 14 and collecting manifolds 15 and transported via the outlet conduits 16. The two phase mixture is discharged to the horizontal vessels 8. In the horizontal vessel 8, the mixture is divided into water and wet-steam. The water is discharged to downcomer conduit 9 and the wet-steam is discharged through wet-steam piping 17 to the vertical vessel 18. In the vertical vessel 18, remaining liquid is separated from dried steam. Flow medium in the liquid phase is discharged through the liquid drain piping 19 to the inlet conduits 10, distributing manifolds 11 and distributing headers 12 back to the evaporator heat transfer section 3.

The invention claimed is:

1. An evaporator system for an industrial boiler, comprising:

a heat transfer system for generating a water-steam mixture, a separator for separating water and steam from the water-steam mixture, and a dryer for drying separated wet steam, wherein the separator comprises at least one horizontal vessel containing a required minimum amount of water, a relatively small steam volume and internals for the separation of water and wet-steam, wherein the dryer comprises at least one vertical vessel containing internals for drying the wet steam to predetermined values by separating liquid from the wet-steam, wherein the at least one horizontal vessel and the at least one vertical vessel are connected to each other by at least one wet-steam piping through which separated wet-steam is transported from the at least one horizontal vessel to the at least one vertical vessel, wherein the at least one horizontal vessel comprises a connection to outlet conduits of an at least one evaporator heat transfer section of the heat transfer system for transporting a water-steam mixture from the at least one evaporator heat transfer section to the at least one horizontal vessel, wherein the at least one horizontal vessel further comprises a connection to at least one downcomer conduit for transporting water from the at least one horizontal vessel back to inlet conduits of the at least one evaporator heat transfer section, wherein the at least one vertical vessel comprises a connection to at least one dry-steam piping for discharging dried steam out the vertical vessel, and wherein the at least one vertical vessel comprises a connection to a liquid drain piping for transporting liquid from the at least one vertical vessel back to the inlet conduits of the at least one evaporator heat transfer section.

2. The evaporator system according to claim 1, wherein the liquid drain piping comprises one common liquid drain pipe, where separated liquid from multiple vertical vessels is collected and wherein the one common drain pipe is of large enough diameter to ensure negligible friction pressure loss when liquid is transported from the multiple vertical vessels to the inlet conduits of the heat transfer section.

* * * * *